US008978667B2

(12) United States Patent
Lammon

(10) Patent No.: US 8,978,667 B2
(45) Date of Patent: Mar. 17, 2015

(54) APPARATUS AND METHOD FOR MANAGING HAIR PINS

(71) Applicant: Brittany Kae Lammon, Ft. Lauderdale, FL (US)

(72) Inventor: Brittany Kae Lammon, Ft. Lauderdale, FL (US)

( * ) Notice: Subject to any disclaimer, the term of this patent is extended or adjusted under 35 U.S.C. 154(b) by 0 days.

(21) Appl. No.: 14/216,622

(22) Filed: Mar. 17, 2014

(65) Prior Publication Data

US 2014/0261513 A1 Sep. 18, 2014

Related U.S. Application Data

(60) Provisional application No. 61/800,385, filed on Mar. 15, 2013.

(51) Int. Cl.

| | |
|---|---|
| ***A45D 24/00*** | (2006.01) |
| ***A45D 7/00*** | (2006.01) |
| ***A45D 8/18*** | (2006.01) |
| ***A44B 6/00*** | (2006.01) |
| ***A45F 5/00*** | (2006.01) |
| ***A45D 44/00*** | (2006.01) |

(52) U.S. Cl.
CPC *A45D 44/00* (2013.01); *A45D 8/18* (2013.01); *A45F 2005/008* (2013.01)
USPC ..... 132/200; 132/331; 24/3.2

(58) Field of Classification Search
CPC ..... A45D 44/00; A45D 44/02; A45D 44/04; A45D 8/18; A45D 8/185; A44C 5/0007; A44C 5/003; A44C 9/0061; A45F 2005/008
USPC ..... 132/200, 212, 147, 148, 155, 273, 132/279–284, 286, 330, 331, 332; 206/581, 206/823, 38, 336, 337, 350, 37; 63/1.12, 63/12, 3, 3.1, 900; 2/16, 162, 170, 917; 24/3.1, 3.2; 224/219, 267, 575, 576, 224/183; 221/185; 211/13.1, 60.1, 70.1, 211/DIG. 1; 223/108, 109 A; 269/8; D28/75
See application file for complete search history.

(56) References Cited

U.S. PATENT DOCUMENTS

| | | | | |
|---|---|---|---|---|
| 2,067,537 | A * | 1/1937 | Kost et al. | 223/109 R |
| 2,126,051 | A * | 8/1938 | Sievers | 223/109 R |
| 2,150,144 | A * | 3/1939 | Andersen | 132/330 |
| 2,152,897 | A * | 4/1939 | Madore | 24/303 |
| 2,164,623 | A * | 7/1939 | Posner | 335/285 |
| 2,168,432 | A * | 8/1939 | Ordal | 132/331 |

(Continued)

OTHER PUBLICATIONS www.culturemag.com.au/newsfeed/view.aspx?mid=1483 (Nov. 1, 2012).*

*Primary Examiner* — Vanitha Elgart
(74) *Attorney, Agent, or Firm* — Wright Law Group, PLLC; Mark F. Wright

(57) ABSTRACT

The present invention is an apparatus comprising a bobby pin holder, a bobby pin opening mechanism, and an adjustable bracelet made out of a durable material such as a leather strap that wraps around the user's wrist and is secured in place. The most preferred embodiments of the present invention include a bobby pin opening mechanism that has a pair of wedge shaped edges that can be used to open bobby pins by pressing the legs of the bobby pin against one of the wedge shaped edges, thereby forcing the legs of the bobby pin apart and opening the bobby pin for use by a hair dresser or hair stylist. Additionally, one or more ridges formed in the body of the bobby pin opening mechanism may be used to hold the bobby pin opened and ready for use.

14 Claims, 10 Drawing Sheets

(56) References Cited

U.S. PATENT DOCUMENTS

| | | | | | |
|---|---|---|---|---|---|
| 2,176,052 | A | * | 10/1939 | Beyer | 132/331 |
| 2,230,394 | A | * | 2/1941 | Young | 132/330 |
| 2,383,207 | A | * | 8/1945 | Morrell | 221/36 |
| 2,436,607 | A | * | 2/1948 | Rosenthal | 224/183 |
| 2,507,031 | A | * | 5/1950 | Maggio et al. | 132/331 |
| 2,509,897 | A | * | 5/1950 | Williams et al. | 132/330 |
| 2,511,768 | A | * | 6/1950 | Carlson | 132/330 |
| 2,513,971 | A | * | 7/1950 | Skinner | 132/331 |
| 2,535,170 | A | * | 12/1950 | Stephenson | 132/331 |
| 2,544,595 | A | * | 3/1951 | Haase | 132/330 |
| 2,546,528 | A | * | 3/1951 | Snyder | 132/331 |
| 2,548,561 | A | * | 4/1951 | Sewol | 132/330 |
| 2,551,884 | A | * | 5/1951 | Jackson | 132/331 |
| 2,551,991 | A | * | 5/1951 | Armstrong et al. | 132/331 |
| 2,582,457 | A | * | 1/1952 | Roberts | 132/330 |
| 2,600,092 | A | * | 6/1952 | Buelow | 132/331 |
| 2,602,456 | A | * | 7/1952 | Le Master | 132/331 |
| 2,624,346 | A | * | 1/1953 | Epps, Jr. | 132/330 |
| 2,710,612 | A | * | 6/1955 | Reilly | 132/331 |
| 2,785,687 | A | * | 3/1957 | Richardson | 132/330 |
| 2,832,355 | A | * | 4/1958 | Mater et al. | 132/330 |
| 2,843,136 | A | * | 7/1958 | Limburg | 132/330 |
| 3,162,202 | A | * | 12/1964 | Apri et al. | 132/330 |
| 3,755,857 | A | * | 9/1973 | Simoneaux | 24/3.2 |
| 4,371,084 | A | * | 2/1983 | Weinrauch | 211/126.1 |
| 7,310,035 | B2 | * | 12/2007 | Wooten | 335/306 |
| 2003/0052143 | A1 | * | 3/2003 | Devine | 224/183 |

* cited by examiner

APPARATUS AND METHOD FOR MANAGING HAIR PINS

RELATED APPLICATIONS

This patent application claims the benefit of U.S. Provisional Patent Application Ser. No. 61/800,385, which application was filed on Mar. 15, 2013, which application is and which application is incorporated herein by reference.

BACKGROUND OF THE INVENTION

1. Technical Field

The present invention generally relates to hair styling and relates more specifically to implements used in conjunction with hair cutting and hair styling.

2. Background Art

Styling and cutting hair is a skill and an art, much more than a science. Although the standard implements used in cutting hair are well known, the method of use for many common hair-cutting and hair styling implements can vary widely from stylist to stylist and from barber to barber.

In general, a stylist or barber will need to use a variety of implements when working on a client's hair. For example, clippers, scissors, combs, spray bottles, razors, and bobby pins are just a few of the more commonly used implements. Since the stylist or barber only has two hands, many stylists and barbers find that they are frequently putting down one object to exchange it for another, only to switch back to the previous object after a very short period of time. It is not uncommon for the stylist or barber to use various methods to try and minimize the number of times that they have to switch objects out because each switch will add time to the haircutting and styling process, thereby reducing the flow of clients, and the potential for income.

For example, it is not uncommon for a stylist or barber to wear an apron or vest that holds various implements and objects that may be used in the haircutting and styling process. Additionally, the stylist or barber may hold one or more implements or objects in their mouth so as to provide quick and easy access to the implement or object. A stylist may hold bobby pins in their mouth so as to have quick and easy access to the bobby pins when styling a client's hair. While this process is efficient, the process is likely unsanitary and not likely to be acceptable for most clients, particularly in upscale salons. Additionally, the stylist may chip or damage their teeth or gums when moving bobby pins into or out of their mouth.

Recognizing the problem, a number of inventors have offered various solutions to address the handling of bobby pins by stylists and barbers. For example, U.S. Pat. No. 2,226,237, issued on Dec. 24, 1940, to Charles A. Cooper, discloses a bobby pin opener combined with a tray for holding bobby pins.

U.S. Pat. No. 2,230,394, issued on Feb. 4, 1941, to Joseph Stephen Young, discloses a portable bobby pin opener in the form of a box with a wedge for opening bobby pins.

U.S. Pat. No. 2,441,947, issued on May 25, 1948, to Clarence M. Welch, discloses a bobby pin opener on a finger ring.

U.S. Pat. No. 2,460,562, issued on Feb. 1, 1949, to Ted H. Worrell, discloses a bobby pin opener to be worn on a finger.

U.S. Pat. No. 2,480,581, issued on Aug. 30, 1949, to Gerald K. Hopkins, discloses a bobby pin opener on a finger ring.

U.S. Pat. No. 2,506,859, issued on May 9, 1950, to Lena Des Saulles, discloses bobby pin opener to be worn on a finger, with a magnetic plate to hold one or more bobby pins.

U.S. Pat. No. 2,507,031, issued on May 9, 1950, to Paul J. Maggio and Leon F. Smith, discloses a bobby pin opener designed to be gripped by the user's teeth.

U.S. Pat. No. 2,535,170, issued on Dec. 26, 1950, to Doris G. Stephenson, discloses a bobby pin holder having a bent plate with a slot that may be mounted on a wall or a finger ring.

U.S. Pat. No. 2,543,356, issued on—Feb. 27, 1951, to George W. Deuillet, discloses a bobby pin opener with a slit on a finger ring.

U.S. Pat. No. 2,546,528, issued on Mar. 27, 1951, to John R. Snyder, discloses a bobby pin opener worn on the wrist, with a "circumferential flange" that is used to open the bobby pin.

U.S. Pat. No. 4,926,718, issued on May 22, 1990, to Graham R. Cook, discloses a magnetic nail holding tool worn on the thumb.

U.S. Pat. No. 5,196,818, issued on Mar. 23, 1993, to Steven P. Anderson, discloses a wrist mounted magnetic holder, with no opener for bobby pins.

U.S. Pat. No. 5,507,041, issued on Apr. 16, 1996, to Robert C. Wright, discloses a magnetic needle holding apparatus to be worn on a finger.

U.S. Pat. No. 5,593,073, issued on Jan. 14, 1997, to Danny Finnegan, discloses a workman's wrist band, with magnets for holding metal objects, attached with Velcro®.

U.S. Pat. No. 6,643,845, issued on Nov. 11, 2003, to O'Dea et al., discloses work gloves with magnets in a pocket.

U.S. Pat. No. Des. 298,484, issued on Nov. 15, 1988, to Lloyd W. Austin, discloses a design for a wrist-mounted holder for pins and other metal objects.

U.S. Pat. No. D554,290, issued on October 2007, to Mathew Zandt, discloses a design for a hair clip display having a wedge that the hair clips can be placed over.

European Patent Application No. 2.055 205, published on May 6, 2009, inventor Jui-Ming Tu, discloses a bobby pin including a clamping rib unit and a hair fork.

While all of these inventions are useful in their own right, none of the above inventions and disclosures, taken either singly or in combination, is seen to simply and efficiently solve the problems associated with managing bobby pins, particularly for hair stylists. Accordingly, without improvements in the management of implements and methods used for cutting and styling hair, the process and results for many haircuts will continue to be sub-optimal.

BRIEF SUMMARY OF THE INVENTION

The present invention is an apparatus comprising a bobby pin holder, a bobby pin opening mechanism, and an adjustable bracelet made out of a durable material such as a leather strap that wraps around the user's wrist and is secured in place. The most preferred embodiments of the present invention include a bobby pin opening mechanism that has a pair of wedge shaped edges that can be used to open bobby pins by pressing the legs of the bobby pin against one of the wedge shaped edges, thereby forcing the legs of the bobby pin apart and opening the bobby pin for use by a hair dresser or hair stylist. Additionally, one or more ridges formed in the body of the bobby pin opening mechanism may be used to hold the bobby pin opened and ready for use.

The apparatus may be secured with any type of fastener or closure mechanism known to those skilled in the art including one or more buckles, snaps, hook and loop fasteners (e.g., Velcro®), etc. Alternatively, the apparatus may incorporate a layered, flexible stainless steel bistable spring band sealed within the strap material. The bracelet can be straightened out, making tension within the springy metal bands. The straightened bracelet is then slapped against the wearer's forearm, causing the bands to spring back into a curve that wraps around the wrist, thereby securing the bracelet to the wearer's wrist.

The most preferred embodiments of the present invention are distinguishable from previous inventions in that it has a uniquely designed apparatus positioned on the strap to open the bobby pins, a flexible strap that fits around the wrist, as well as one or more magnets positioned on the flexible strap.

Accordingly, it is a principal object of the invention to enable a user to open bobby pins without damage to the user's teeth or mouth.

It is another object of the invention to enable a user to conveniently retain bobby pins on her/his wrist.

It is a further object of the invention to enable a user to pick up and open a bobby pin with a single hand.

Still another object of the invention is to save time spent retrieving and opening bobby pins.

It is an object of the invention to provide improved elements and arrangements thereof in an apparatus for the purposes described which are inexpensive, and fully effective in is dependable accomplishing its intended purposes.

These and other objects of the present invention will become readily apparent upon further review of the following specification and the attendant claims.

BRIEF DESCRIPTION OF THE FIGURES

The preferred embodiments of the present invention will hereinafter be described in conjunction with the appended drawings, wherein like designations denote like elements, and.

DETAILED DESCRIPTION

The present invention is an apparatus comprising a bobby pin holder, a bobby pin opening mechanism, and an adjustable bracelet made out of a durable material such as a leather strap that wraps around the user's wrist and is secured in place. The present invention is an apparatus comprising a bobby pin holder, a bobby pin opening mechanism, and an adjustable bracelet made out of a durable material such as a leather strap that wraps around the user's wrist and is secured in place. The most preferred embodiments of the present invention include a bobby pin opening mechanism that has a pair of wedge shaped edges that can be used to open bobby pins by pressing the legs of the bobby pin against one of the wedge shaped edges, thereby forcing the legs of the bobby pin apart and opening the bobby pin for use by a hair dresser or hair stylist. Additionally, one or more ridges formed in the body of the bobby pin opening mechanism may be used to hold the bobby pin opened and ready for use.

The apparatus may be secured with a buckle, with snaps, or hook and loop fasteners (e.g., Velcro®). Alternatively, the apparatus may incorporate a layered, flexible stainless steel bistable spring band sealed within the strap material. The bracelet can be straightened out, making tension within the springy metal bands. The straightened bracelet is then slapped against the wearer's forearm, causing the bands to spring back into a curve that wraps around the wrist, thereby securing the bracelet to the wearer's wrist.

Figure 1:
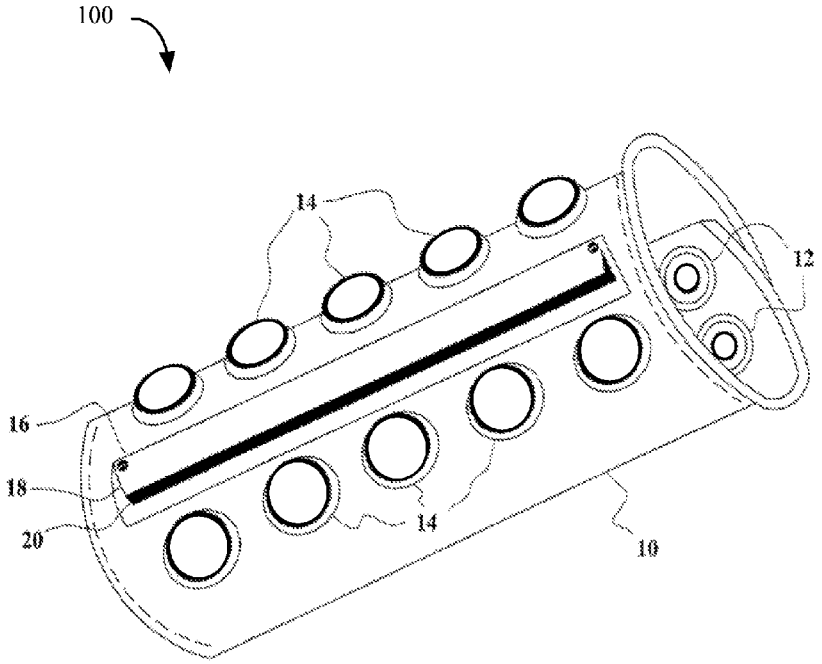
FIG. 1 is a perspective view of a wrist strap with magnets and a bobby pin opening mechanism in accordance with a preferred exemplary embodiment of the present invention.

Referring now to FIG. 1, a perspective view of a wrist strap 100 with magnets and a bobby pin opening mechanism in accordance with a preferred exemplary embodiment of the present invention is depicted. As shown in FIG. 1, it comprises a bracelet 10 made out of a leather strap (or other suitable material) that wraps around the user's wrist and is secured with snaps 12 or hook and loop fasteners (e.g., Velcro®). There are two rows of round magnets 14, one located on either side of bobby pin opener 16, that hold the bobby pins, and thus saves the hair stylist or other user time retrieving them from a less convenient location. Bobby pin opener 16, comprising a rectangular thimble wedge 18 and raised groove 20, is attached to the bracelet, and allows single hand opening of the bobby pins. In one single motion, the user can pick the bobby pin up from the magnet, and open it on the bobby pin opener, to put in their client's or their own hair, without using her/his mouth and/or teeth.

Figure 2:
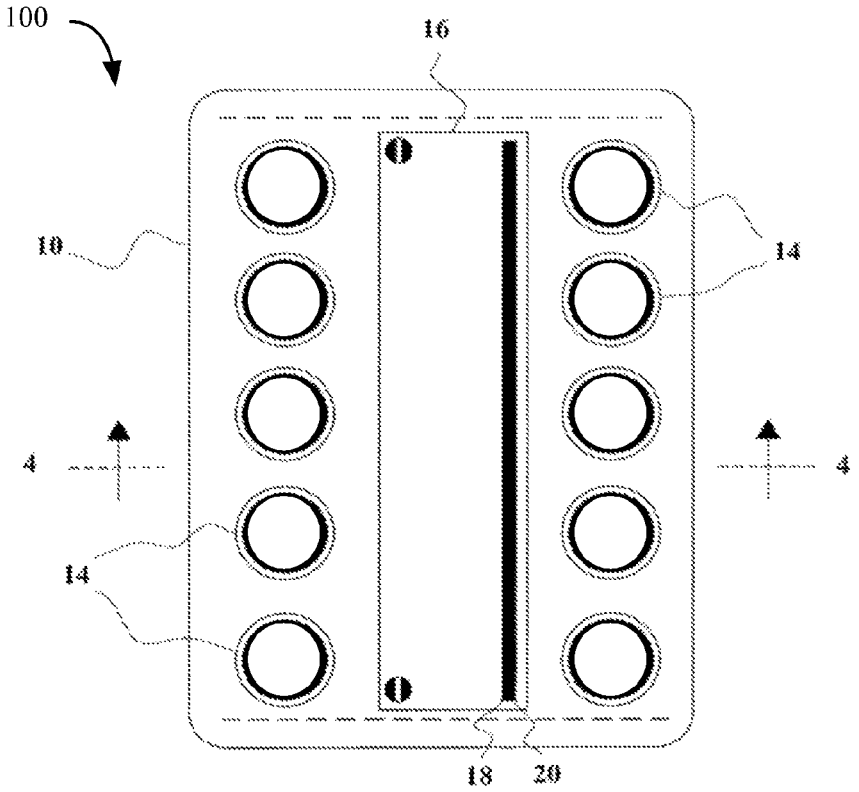
FIG. 2 is a top view of a wrist strap with magnets and a bobby pin opening mechanism in accordance with a preferred embodiment of the present invention.

Referring now to FIG. 2, a top view of a wrist strap with magnets and a bobby pin opening mechanism in accordance with a preferred embodiment of the present invention is depicted. As shown in FIG. 2, is a top view of the invention, showing more clearly how the bobby pin opener 16 is positioned between the two rows of magnets 14 on the top of the bracelet 10.

Figure 3:
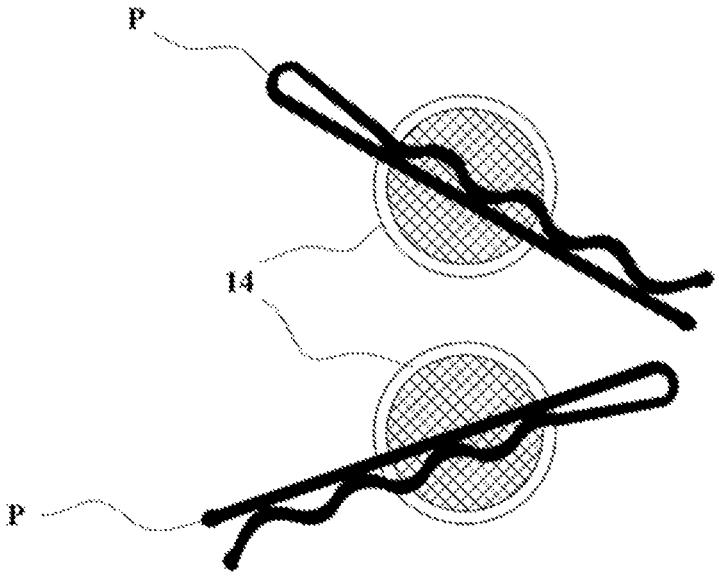
FIG. 3 is a detail view of a wrist strap with magnets and a bobby pin opening mechanism in accordance with a preferred exemplary embodiment of the present invention.

Referring now to FIG. 3, a detail view of magnets 14 of FIG. 1 and FIG. 2, used in conjunction with a bobby pin opening mechanism in accordance with a preferred exemplary embodiment of the present invention is depicted. As shown in FIG. 3, magnets 14 retain the bobby pins P via magnetic attraction. The magnetic attraction should be strong enough to hold bobby pins P in place but not so strong as to make removing bobby pins P from magnets 14 a difficult process.

Figure 4:
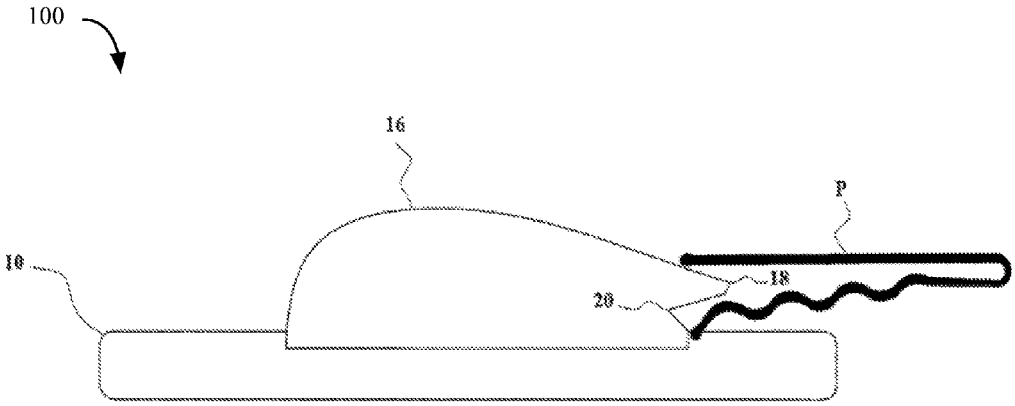
FIG. 4 is a sectional view of a wrist strap with magnets and a bobby pin opening mechanism in accordance with a preferred exemplary embodiment of the present invention taken along line 4-4 of FIG. 2.

Referring now to FIG. 4, a sectional view of an apparatus 100 with magnets 14 and a bobby pin opening mechanism 16 in accordance with a preferred exemplary embodiment of the present invention taken along line 4-4 of FIG. 2 is depicted. As shown in FIG. 4, bobby pin opener 16 is partially embedded in strap 10. Wedge portion 18 extends from the opener, and with groove 20 extending into the opener, enables a user to open the bobby pin P, when its separate ends are pressed into and against wedge portion 18.

Figure 5:
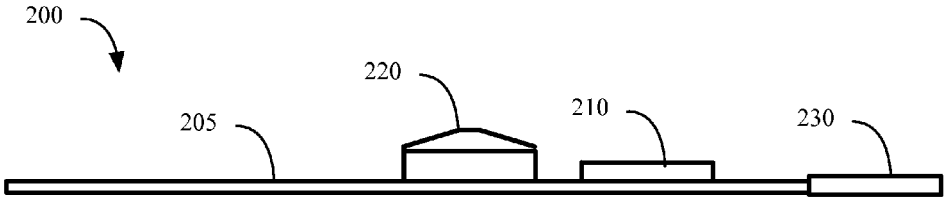
FIG. 5 is a schematic representation of a wrist strap with magnets and a bobby pin opening mechanism in accordance with a preferred exemplary embodiment of the present invention.

Referring now to FIG. 5, a schematic side view of an apparatus 200 comprising a strap 205, a magnet 210 and a bobby pin opening mechanism 220 in accordance with a preferred exemplary embodiment of the present invention is depicted. As shown in FIG. 5, apparatus 200 also includes a fastening mechanism 230. Fastening mechanism 230 is any type of mechanism that may be used to fasten apparatus 200 in place on the user's arm. For example, a buckle, hook and loop fasteners, snaps, etc. are all suitable for use as a fastening mechanism 230.

Figure 6:
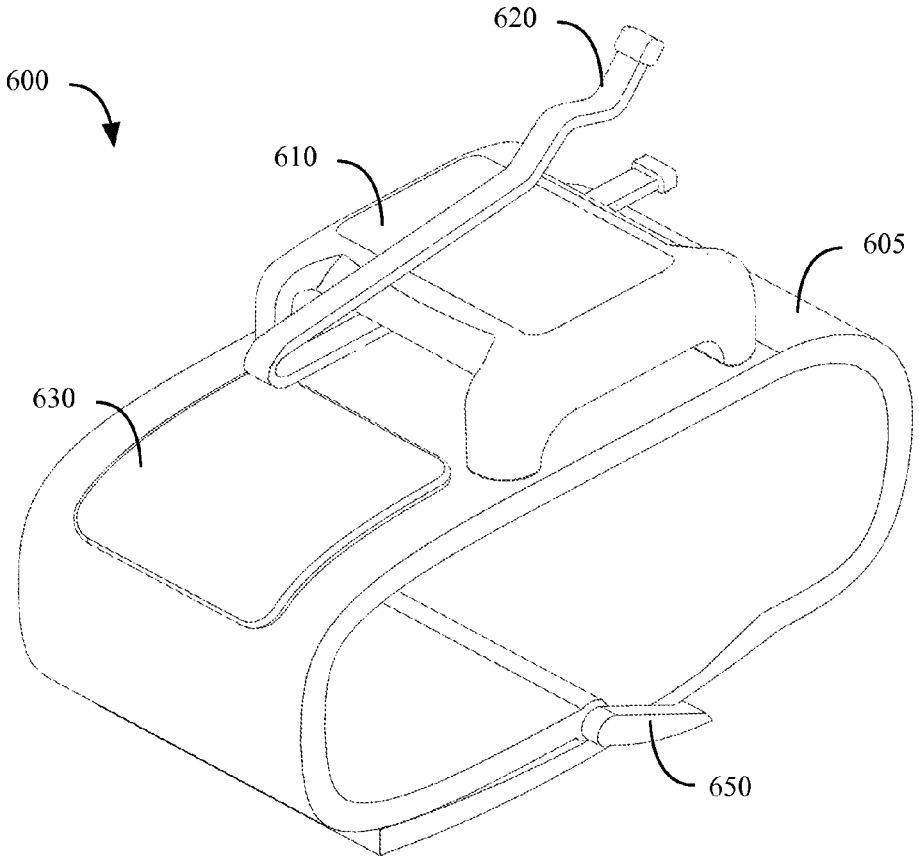
FIG. 6 is a perspective view of a wrist strap with magnets and a bobby pin opening mechanism in accordance with a preferred exemplary embodiment of the present invention.

Referring now to FIG. 6, a perspective view of an apparatus 600 for opening bobby pins is depicted. As shown in FIG. 6, apparatus 600 comprises a wrist strap or wrist band 605; a magnetic portion 630; a bobby pin opening mechanism 610, and a fastener 650. As shown in FIG. 6, a bobby pin 620 can be opened by pressing it against bobby pin opening mechanism 610, thereby separating the legs of bobby pin 620. With the first leg and the second leg trapped or placed in a fixed position, the bobby pin is held in place in an opened position. The bobby pin can be stored on magnetic portion 630 until needed and then opened with a single hand. Magnetic portion 630 may be affixed to the surface of wrist strap 605 or embedded inside one or more layers of wrist strap 605.

Figure 7:
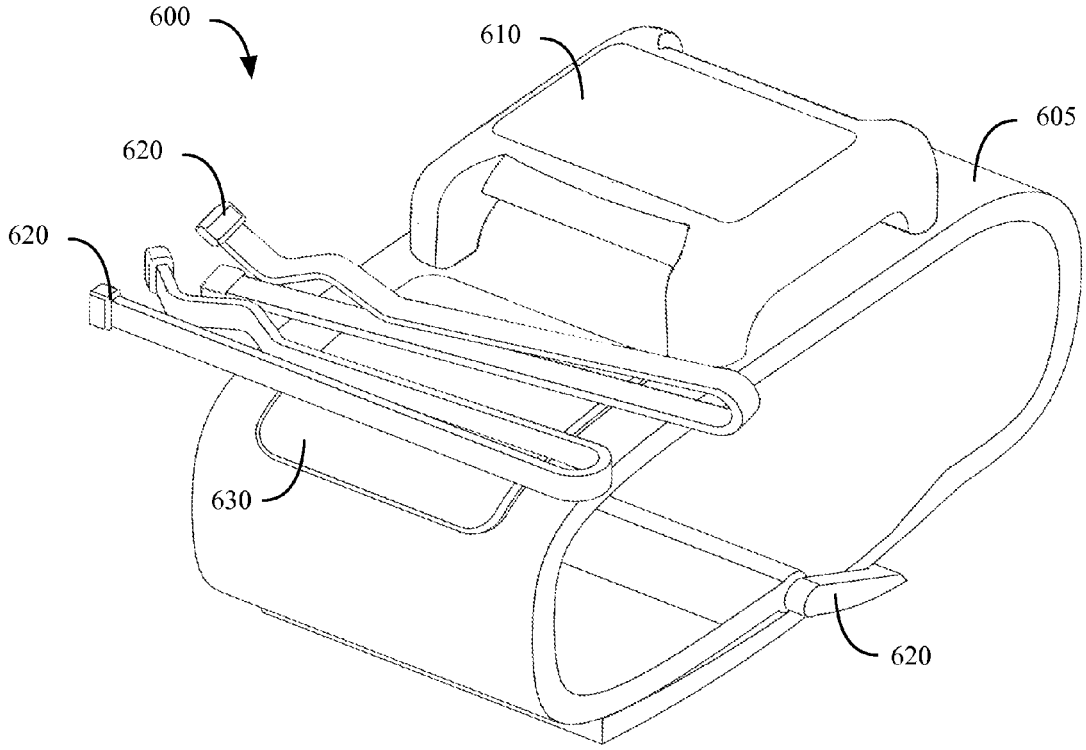
FIG. 7 is a perspective view of a wrist strap with magnets and a bobby pin opening mechanism in accordance with a preferred exemplary embodiment of the present invention.

Referring now to FIG. 7, a perspective view of apparatus 600, including a wrist strap 605, magnetic portion 630, and bobby pin opening mechanism 610 in accordance with a preferred exemplary embodiment of the present invention is depicted. As shown in FIG. 7, a plurality of bobby pins 620 may be stored on magnetic portion 630 until such time as they are needed by the hair stylist. Fastener 650 is used to secure wrist strap 605 to the arm of the stylist during use.

Figure 8:
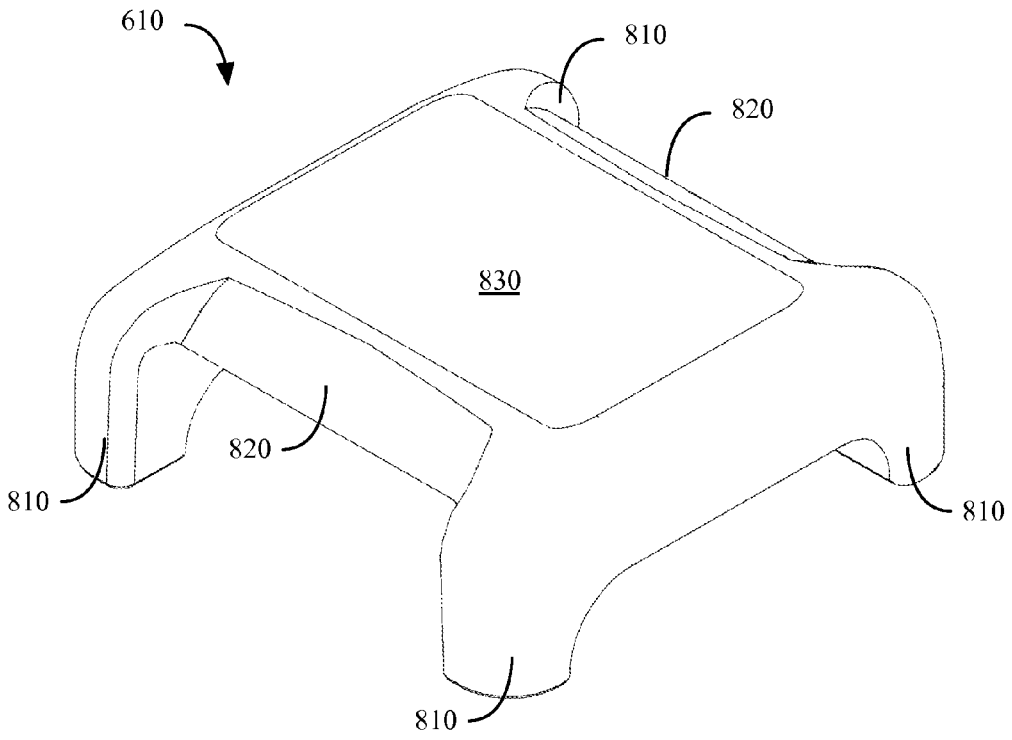
FIG. 8 is a perspective view of the bobby pin opening mechanism of FIG. 7 in accordance with a preferred exemplary embodiment of the present invention.

Referring now to FIG. 8, a perspective view of bobby pin opening mechanism 610 of FIG. 6 and FIG. 7 is depicted. As shown in FIG. 8, the most preferred embodiment of bobby pin opening mechanism 610 comprises four legs 810, a substantially flat surface 830, and a pair of wedge shaped edges 820.

Figure 9:
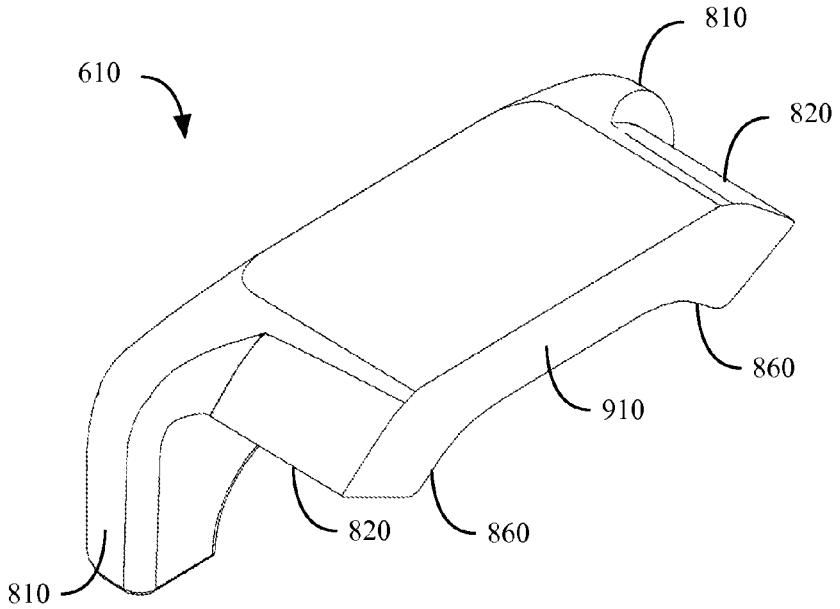
FIG. 9 is a partial perspective cutaway view of the bobby pin opening mechanism of FIG. 7 in accordance with a preferred exemplary embodiment of the present invention.

Referring now to FIG. 9, a partial perspective cutaway view of the bobby pin opening mechanism of FIG. 8 is depicted. As shown in FIG. 9, wedge shaped edges 820 are actually part of a continuous body portion 910. Body portion 910 is most preferably a curvilinear object that is shaped like the uppermost arch portion of a segmental arch (e.g., the arch portion, not the support legs of the arch) with a slightly flattened portion at the top of the arch. Wedge shaped edges 820 form a location for opening one or more bobby pins. In addition, the bottom of body portion 910 further comprises a pair of ridges 860. Ridges 860 are useful to capture or "trap" the ends of a bobby pin, thereby holding the bobby pin in place in the opened position until the stylist needs it. The stylist can press the bobby pin onto one of either wedge shaped edges 820 and then release the bobby pin with one of ridges 860 serving to hold the bobby pin in place even if after it has been released. This allows the stylist to make any adjustment necessary and then easily grasp the opened bobby pin in one hand and place in the desired location.

Figure 10:
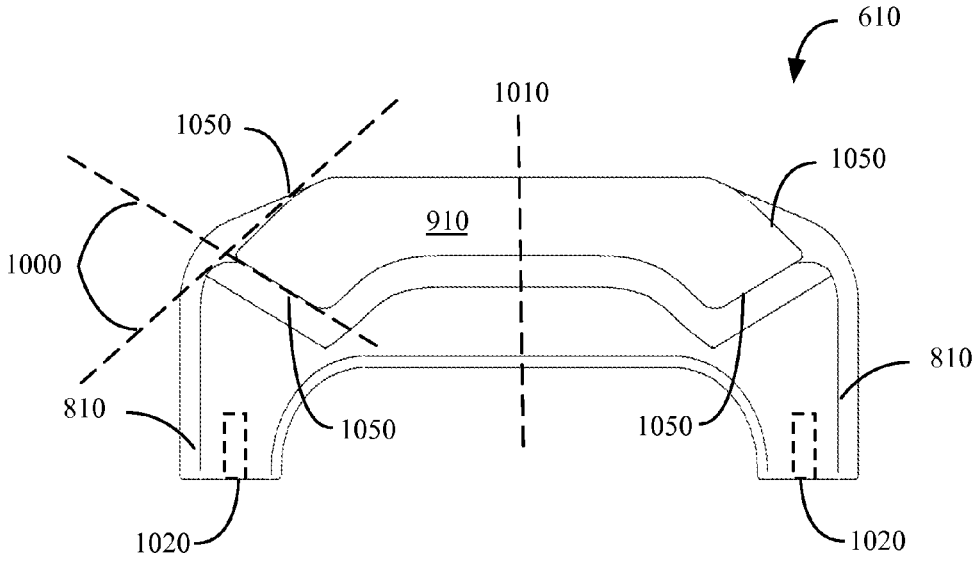
FIG. 10 is a perspective side sectional view of the bobby pin opening mechanism of FIG. 7 in accordance with a preferred exemplary embodiment of the present invention.

Referring now to FIG. 10, a side sectional view of bobby pin opening mechanism 600 of FIG. 8 is depicted. As shown in FIG. 10, there are two substantially flat surfaces 1050 that intersect or meet to form each wedge shaped edge 820. In the most preferred embodiments of the present invention, the angle 1000 formed by flat surfaces 1050 is greater than 30° but less than 90°. Additionally, a mounting aperture 1020 will be formed in each leg 810. Mounting apertures 1020 are most preferably holes that are adapted to receive a screw or other fastening mechanism, thereby providing for bobby pin opening mechanism 600 to be attached to wrist strap 605. It should be noted that bobby pin opening mechanism 600 is substantially symmetrical about axis 1010, thereby providing for bobby pin opening mechanism 600 to be mounted in a number of ways, so as to accommodate accessibility for right and left handed stylists.

Figure 11:
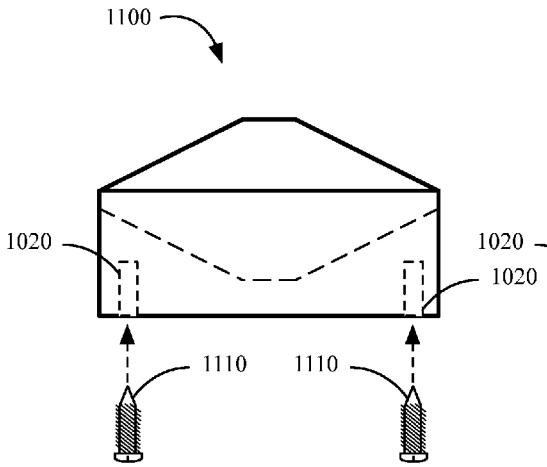
FIG. 11 is a side view of a bobby pin opening mechanism in accordance with an alternative preferred exemplary embodiment of the present invention.

Referring now to FIG. 11, a left side view of a bobby pin opening mechanism 1100 in accordance with an alternative preferred exemplary embodiment of the present invention is depicted.

Figure 12:
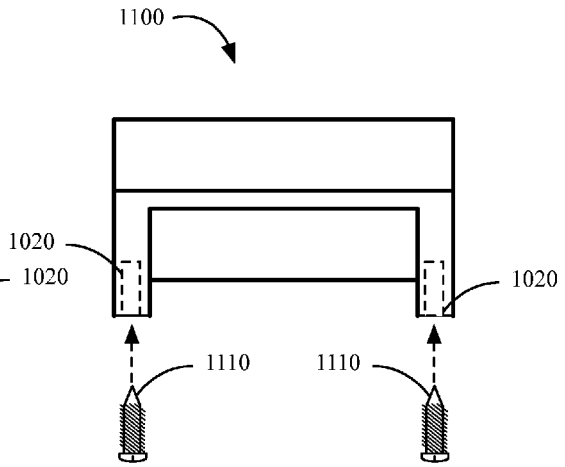
FIG. 12 is a side view of a bobby pin opening mechanism in accordance with an alternative preferred exemplary embodiment of the present invention.

Referring now to FIG. 12, a right side view of a bobby pin opening mechanism in accordance with an alternative preferred exemplary embodiment of the present invention is depicted.

Figure 13:
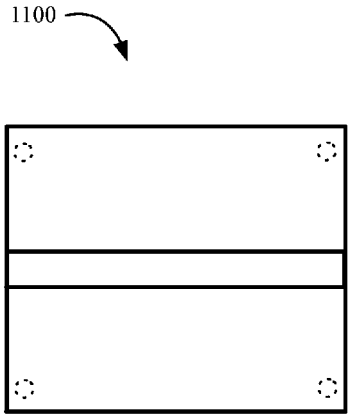
FIG. 13 is a top view of a bobby pin opening mechanism in accordance with an alternative preferred exemplary embodiment of the present invention.

Referring now to FIG. 13, a top view of a bobby pin opening mechanism in accordance with an alternative preferred exemplary embodiment of the present invention is depicted.

Figure 14:
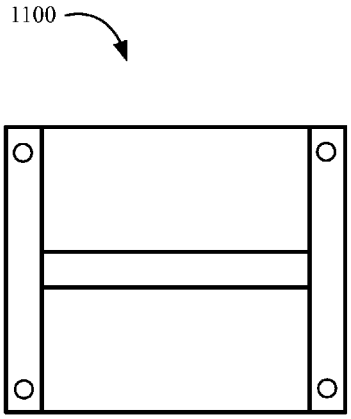
FIG. 14 is a bottom view of a bobby pin opening mechanism in accordance with an alternative preferred exemplary embodiment of the present invention.

Referring now to FIG. 14, a bottom view of a bobby pin opening mechanism in accordance with an alternative preferred exemplary embodiment of the present invention is depicted.

Referring now to FIGS. 11-14, the various views present a slightly modified version of a bobby pin opening mechanism 1100 in accordance with an alternative preferred exemplary embodiment of the present invention. While not the most preferred embodiment, additional unique features are present in this embodiment. Specifically, FIG. 11 shows screws 1110 being inserted into mounting apertures 1020 of FIG. 10.

Figure 15:
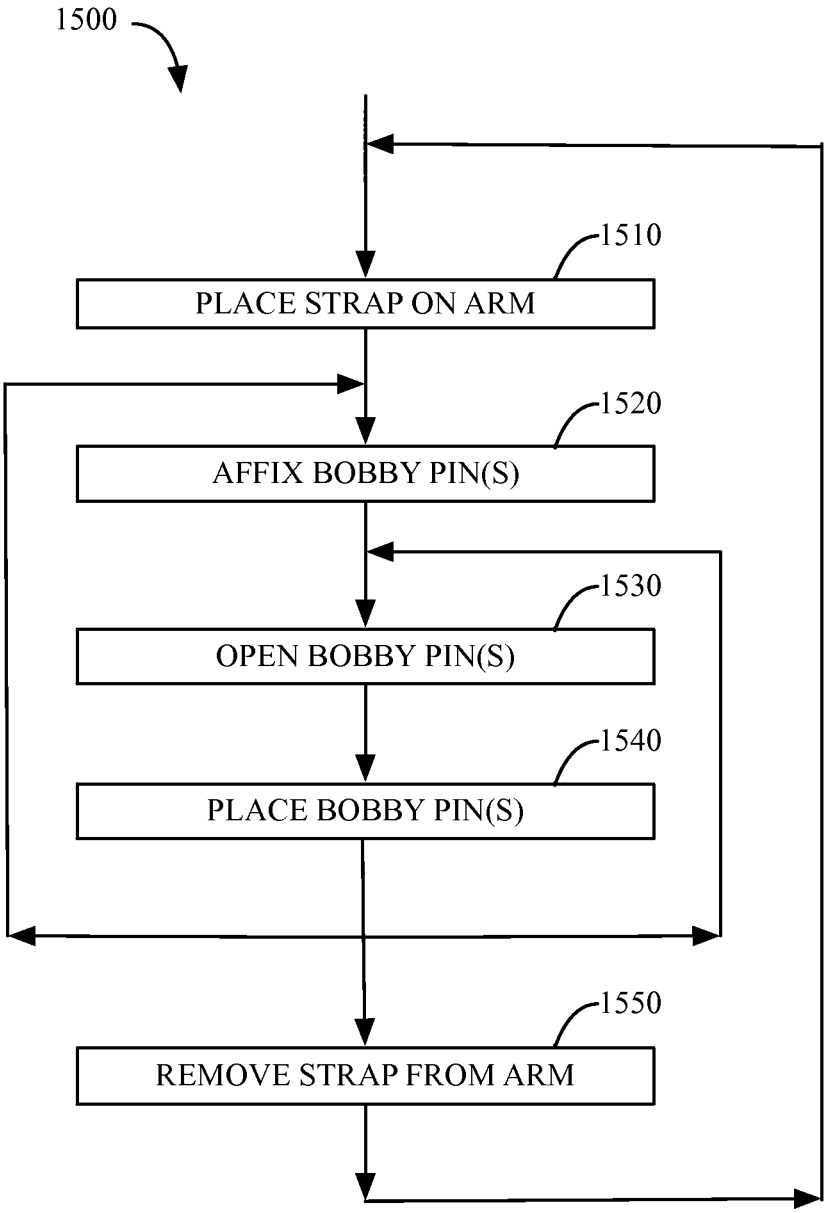
FIG. 15 is a flow chart of a method for using a wrist strap with magnets and a bobby pin opening mechanism in accordance with a preferred embodiment of the present invention.

Referring now to FIG. 15, a flow chart of a method for using a wrist strap with magnets and a bobby pin opening mechanism in accordance with a preferred embodiment of the present invention is depicted. As shown in FIG. 15, the stylist can affix the strap to his or her arm (step 1510) and then affix one or more bobby pins to the magnetic portion (step 1520). Then, as needed, the stylist can use the bobby pin opening mechanism to open one or more bobby pins (step 1530) and place the bobby pins in the desired location (step 1540). This process can continue as necessary until the desired outcome has been achieved at which time the stylist can remove the strap from his or her arm (step 1550).

From the foregoing description, it should be appreciated that the apparatus and methods for styling hair is provided by the various preferred embodiments of the present invention offer significant benefits that would be apparent to one skilled in the art. For example, those skilled in the art will understand that additional preferred embodiments of the apparatus and methods described herein could be readily adapted for use in pet grooming as well as other applications.

Furthermore, while multiple preferred embodiments have been presented in the foregoing description, it should be appreciated that a vast number of variations in the preferred embodiments exist. Lastly, it should be appreciated that these embodiments are preferred exemplary embodiments only and are not intended to limit the scope, applicability, or configuration of the invention in any way. Rather, the foregoing detailed description provides those skilled in the art with a convenient road map for implementing a preferred exemplary embodiment of the invention, it being understood that various changes may be made in the function and arrangement of elements described in the exemplary preferred embodiment without departing from the spirit and scope of the invention as set forth in the appended claims.

The invention claimed is:

1. An apparatus comprising:

a wrist band;

a magnetic portion coupled to the wristband;

a bobby pin opening mechanism coupled to the wristband, the bobby pin opening mechanism comprising:

four legs;

a mounting aperture formed in each of the four legs;

four screws, with each of the four screws being inserted through the wrist band and into one of the mounting apertures, thereby securing the bobby pin opening mechanism to the wristband;

a body portion comprising two wedge shaped edges; and a fastening mechanism affixed to the wrist band.

2. The apparatus of claim 1 wherein the fastening mechanism comprises one of a buckle, a hook and loop fastener, and at least one snap.

3. The apparatus of claim 1 wherein the fastening mechanism comprises a bistable spring band contained with the wrist strap.

4. The apparatus of claim 1 wherein the bobby pin opening mechanism further comprises a pair of ridges, the ridges being configured to separate a first leg and a second leg of a bobby pin and fix the first leg and the second leg in a fixed position, thereby holding the bobby pin in an opened position.

5. The apparatus of claim 1 further comprising a plurality of bobby pins fixed in place on the magnetic portion.

6. The apparatus of claim 1 wherein the body portion comprises a substantially curvilinear object with a cross sectional shape of an uppermost arch portion of a segmental arch with a slightly flattened portion at the top of the arch.

7. The apparatus of claim 1 one wherein each of the two wedge shaped edges is formed by a pair of intersecting substantially flat surfaces, wherein the intersection of the pair of intersecting substantially flat surfaces forms an angle greater than 30° but less than 90°.

8. An apparatus for managing bobby pins, the apparatus comprising:

a leather wrist band;

a magnetic portion coupled to the wristband;

a bobby pin opening mechanism coupled to the wristband, the bobby pin opening mechanism comprising:

four legs;

a mounting aperture formed in each of the four legs;

four screws, with each of the four screws being inserted through the wrist band and into one of the mounting apertures, thereby securing the bobby pin opening mechanism to the wristband;

a body portion, the body portion comprising:

a substantially curvilinear object with a cross sectional shape of an uppermost arch portion of a segmental arch with a slightly flattened portion at the top of the arch;

two wedge shaped edges, wherein each of the two wedge shaped edges is formed by a pair of intersecting substantially flat surfaces, wherein the intersection of the pair of intersecting substantially flat surfaces forms an angle greater than 30° but less than 90°; and a pair of ridges, the ridges being configured to separate a first leg and a second leg of a bobby pin and fix the first leg and the second leg in a fixed position, thereby holding the bobby pin in an opened position; and a fastening mechanism affixed to the wrist band, the fastening mechanism comprising one of a buckle, a hook and loop fastener, and at least one snap.

9. A method, the method comprising the steps of:

affixing an apparatus to a user's wrist, the apparatus comprising:

a wrist band;

a magnetic portion coupled to the wrist band;

a bobby pin opening mechanism coupled to the wrist band, the bobby pin opening mechanism comprising:

four legs;

a mounting aperture formed in each of the four legs; and two wedge shaped edges; and a fastening mechanism affixed to the wrist band, the fastening mechanism comprising one of a buckle, a hook and loop fastener, and at least one snap;

placing at least one bobby pin on the magnetic portion;

removing the at least one bobby pin from the magnetic portion;

pushing the at least one bobby pin against the bobby pin opening mechanism, thereby creating a distance between the first leg and the second leg of the bobby pin;

placing the at least one bobby pin in a desired location; and removing the wrist band from the user's wrist.

10. The method of claim 9 wherein the at least one bobby pin comprises a plurality of bobby pins and wherein the step of placing the at least one bobby pin on the magnetic portion comprises the step of placing the plurality of bobby pins on the magnetic portion and wherein the step of pushing the at least one bobby pin against the bobby pin opening mechanism, thereby creating a distance between the first leg and the second leg of the bobby pin comprises the step of pushing the plurality of bobby pins against the bobby pin opening mechanism, one at a time, thereby creating a distance between the first leg and the second leg for each of the plurality of bobby pins and wherein the step of placing the at least one bobby pin in a desired location comprises the step of placing the plurality of bobby pins in a plurality of desired locations.

11. The method of claim 10 wherein the bobby pin opening mechanism further comprises a pair of ridges, the ridges being configured to separate a first leg and a second leg of a bobby pin and fix the first leg and the second leg in a fixed position, thereby holding the bobby pin in an opened position.

12. The method of claim 10 further comprising a plurality of bobby pins fixed in place on the magnetic portion.

13. The method of claim 10 wherein the body portion comprises a substantially curvilinear object with a cross sectional shape of an uppermost arch portion of a segmental arch with a slightly flattened portion at the top of the arch.

14. The method of claim 10 wherein each of the two wedge shaped edges is formed by a pair of intersecting substantially flat surfaces, wherein the intersection of the pair of intersecting substantially flat surfaces forms an angle greater than 30° but less than 90°.

* * * * *